US007863583B2

(12) United States Patent
Daiss et al.

(10) Patent No.: US 7,863,583 B2
(45) Date of Patent: Jan. 4, 2011

(54) DEVICE AND PROCESS FOR CURING USING ENERGY-RICH RADIATION IN AN INERT GAS ATMOSPHERE

(75) Inventors: Andreas Daiss, Mannheim (DE); Erich Beck, Ladenburg (DE); Manfred Biehler, Ilbesheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 965 days.

(21) Appl. No.: 11/629,195

(22) PCT Filed: Jun. 17, 2005

(86) PCT No.: PCT/EP2005/006549

§ 371 (c)(1),
(2), (4) Date: Dec. 11, 2006

(87) PCT Pub. No.: WO2006/000349

PCT Pub. Date: Jan. 5, 2006

(65) Prior Publication Data

US 2008/0311309 A1 Dec. 18, 2008

(30) Foreign Application Priority Data

Jun. 24, 2004 (DE) ..... 10 2004 030 674

(51) Int. Cl.
*G21K 5/02* (2006.01)
*G21K 5/10* (2006.01)

(52) U.S. Cl. ..... 250/455.11; 250/453.11; 250/454.11; 250/492.1; 427/457; 427/493; 427/508

(58) Field of Classification Search ..... 427/493, 427/457, 508, 551, 553, 461, 464, 497, 498, 427/505, 542, 572, 595, 596; 34/245, 259, 34/264, 266, 267, 275, 276, 255; 250/453.11, 250/455.11, 493.1, 494.1, 495.1, 504 R, 454.11, 250/492.1, 503.1
See application file for complete search history.

(56) References Cited

U.S. PATENT DOCUMENTS 4,143,468 A * 3/1979 Novotny et al. ..... 34/276
4,292,152 A 9/1981 Lechtken et al.
4,442,143 A * 4/1984 Reed ..... 427/340

(Continued)

FOREIGN PATENT DOCUMENTS

CA 2 059 145 7/1992

(Continued)

OTHER PUBLICATIONS

Joachim Jung, et al., "UV-Applications in Europe Yesterday-Today-Tomorrow", RadTech Europe 99, Nov. 8-10, 1999, pp. 38-42.

(Continued)

*Primary Examiner*—Jack I Berman
*Assistant Examiner*—Nicole Ippolito Rausch
(74) *Attorney, Agent, or Firm*—Oblon, Sivak, McClelland, Maier & Neustadt, L.L.P.

(57) ABSTRACT

The invention relates to an apparatus and a method of producing molding materials and coatings on substrates by curing radiation-curable materials under an inert gas atmosphere by exposure to high-energy radiation.

25 Claims, 11 Drawing Sheets

U.S. PATENT DOCUMENTS

| | | | | |
|---|---|---|---|---|
| 5,486,384 | A | 1/1996 | Bastian et al. | |
| 5,534,559 | A | 7/1996 | Leppard et al. | |
| 5,565,240 | A * | 10/1996 | Smith | 427/195 |
| 5,921,002 | A * | 7/1999 | Scheufler et al. | 34/269 |
| 6,161,304 | A * | 12/2000 | Iaccino et al. | 34/208 |
| 6,562,464 | B1 | 5/2003 | Schwalm et al. | |
| 6,807,906 | B1 * | 10/2004 | DeMoore et al. | 101/424.1 |
| 7,105,206 | B1 | 9/2006 | Beck et al. | |
| 2003/0186169 | A1 * | 10/2003 | Gallagher et al. | 430/296 |
| 2004/0202790 | A1 * | 10/2004 | Ogata | 427/374.1 |
| 2006/0033054 | A1 * | 2/2006 | Yamada | 250/504 R |
| 2006/0115602 | A1 | 6/2006 | Beck et al. | |

FOREIGN PATENT DOCUMENTS

| | | | |
|---|---|---|---|
| DE | 199 13 353 | A1 | 9/2000 |
| DE | 199 57 900 | A1 | 6/2001 |
| DE | 103 54 165 | B3 | 11/2004 |
| EP | 0 540 884 | A1 | 5/1993 |
| EP | 0 965 621 | A1 | 12/1999 |
| WO | WO 98/33761 | | 8/1998 |
| WO | WO 01/39897 | A2 | 6/2001 |

OTHER PUBLICATIONS

Erich Beck, et al., "UV Curing under Carbon Dioxide", RadTech Conference Proceedings, vol. II, ISBN 3-87870-152-7, Nov. 3-5, 2003, pp. 1-7.

* cited by examiner $F_1$-$F_1$ $F_2$-$F_2$ $F_3$-$F_3$ $F_4$-$F_4$ $F_4$-$F_4$

DEVICE AND PROCESS FOR CURING USING ENERGY-RICH RADIATION IN AN INERT GAS ATMOSPHERE

The invention relates to apparatus and a method of producing molding materials and coatings on substrates by curing radiation-curable materials under an inert gas atmosphere by exposure to high-energy radiation.

The radiation curing of free-radically polymerizable compounds, such as of (meth)acrylate compounds or vinyl ether compounds, for example, may be accompanied by severe oxygen inhibition of the polymerization or cure. This inhibition leads to incomplete surface curing and hence for example to tacky coatings.

This oxygen inhibition effect can be alleviated by using high quantities of photoinitiator, by additionally using coinitiators—amines, for example—or high-energy UV radiation at a high dose—with high-pressure mercury lamps, for example—or by adding barrier-forming waxes.

Also known is the implementation of the radiation cure under an inert protective gas, known for example from EP-A-540884 and from Joachim Jung, RadTech Europe 99, Nov. 8 to 10, 1999, Berlin, Germany (UV-Applications in Europe Yesterday-Today-Tomorrow).

Radiation-curable materials may comprise volatile diluents, such as water or organic solvents, for example, and may also be processed in the absence of such diluents. The technique of radiation curing is suitable for coating systems which are implemented in industrial applications or else in small or medium-sized craft factories or in the domestic sphere. To date, however, the costly and inconvenient implementation of the method and the apparatus required for it, particularly the UV lamps, has prevented application of radiation curing in the nonindustrial sectors.

WO 01/39897 describes a method of radiation curing under an inert gas atmosphere which is heavier than air, preferably carbon dioxide. One preferred embodiment of curing that is described therein takes place in a dip tank.

There is a need for improvement to the method disclosed therein by further reduction in inert gas losses and contamination by atmospheric oxygen, which occur, for example, when the inert gas atmosphere is heated, as a result for example of the heat given off. The desire is to achieve a greater independence of heat sources in the irradiation area and hence also to achieve greater freedom with the selection of the type, positioning, and number of irradiation facilities.

RadTech Conference Proceedings, Nov. 3-5, 2003, Berlin, Germany, Dr. Erich Beck, BASF AG, Germany; "UV Curing under Carbon Dioxide", pp. 855-863; volume II, ISBN 3-87870-152-7 present a method and apparatus for radiation curing under $CO_2$, permitting a continuous method of curing under inert gas. A disadvantage of these is that the consumption of inert gas is still relatively high.

It was an object of the invention to provide apparatus with which a radiation cure can be effected and the consumption of inert gas can be minimized.

This object has been achieved by means of apparatus 1 for effecting a cure of coatings on a substrate S under an inert gas atmosphere, comprising side covers 2, 3, 4 and 5, top and bottom covers 6 and 7, with 2, 3, 4, 5, 6 and 7 together enclosing an interior, one or more dividing walls 8 which subdivide the interior, the dividing walls 8 finishing at the bottom cover 7 and leaving open a distance d1 from the top cover 6, one or more dividing walls 9 which subdivide the interior, the dividing walls 9 finishing at the top cover 6 and leaving open a distance d2 from the bottom cover 7, with 8 and 9, together with the respectively adjacent dividing wall 9 or 8 and, if appropriate, with the side covers 2 or 3, forming a subdivided interior (compartment), at least one radiation source 10 radiating within the interior and/or into the interior, at least one gas supply means 11, with which a gas or gas mixture can be passed into the interior or formed therein, at least one conveying means 12 for the substrate S, inlet 13 and outlet 14, where the dividing walls 8 stand substantially perpendicular to the bottom cover 7, the dividing walls 9 stand substantially perpendicular to the top cover 6, the distances d1 and d2 and also the breadth b of apparatus 1 being chosen such that they are greater than the dimensions of the substrate S along the conveying direction of the conveying means 12, and means 2, 3, 8 and 9 form at least 4 compartments.

Figure 1:
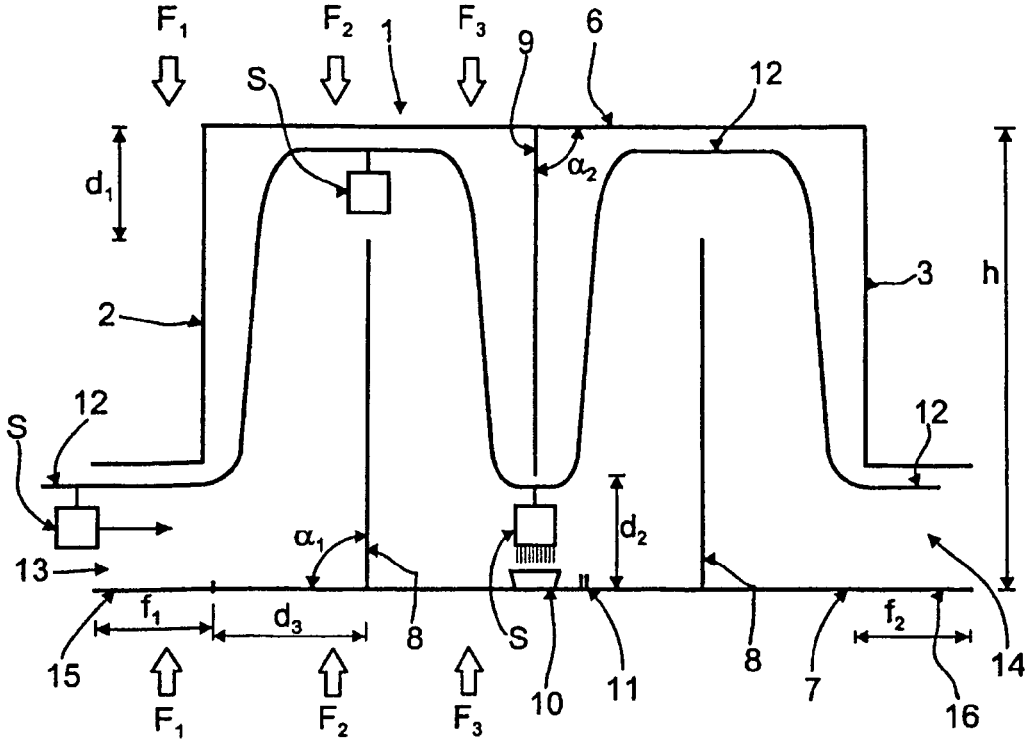
FIG. 1 provides a schematic of one embodiment of an apparatus according to the present invention.
Figure 2:
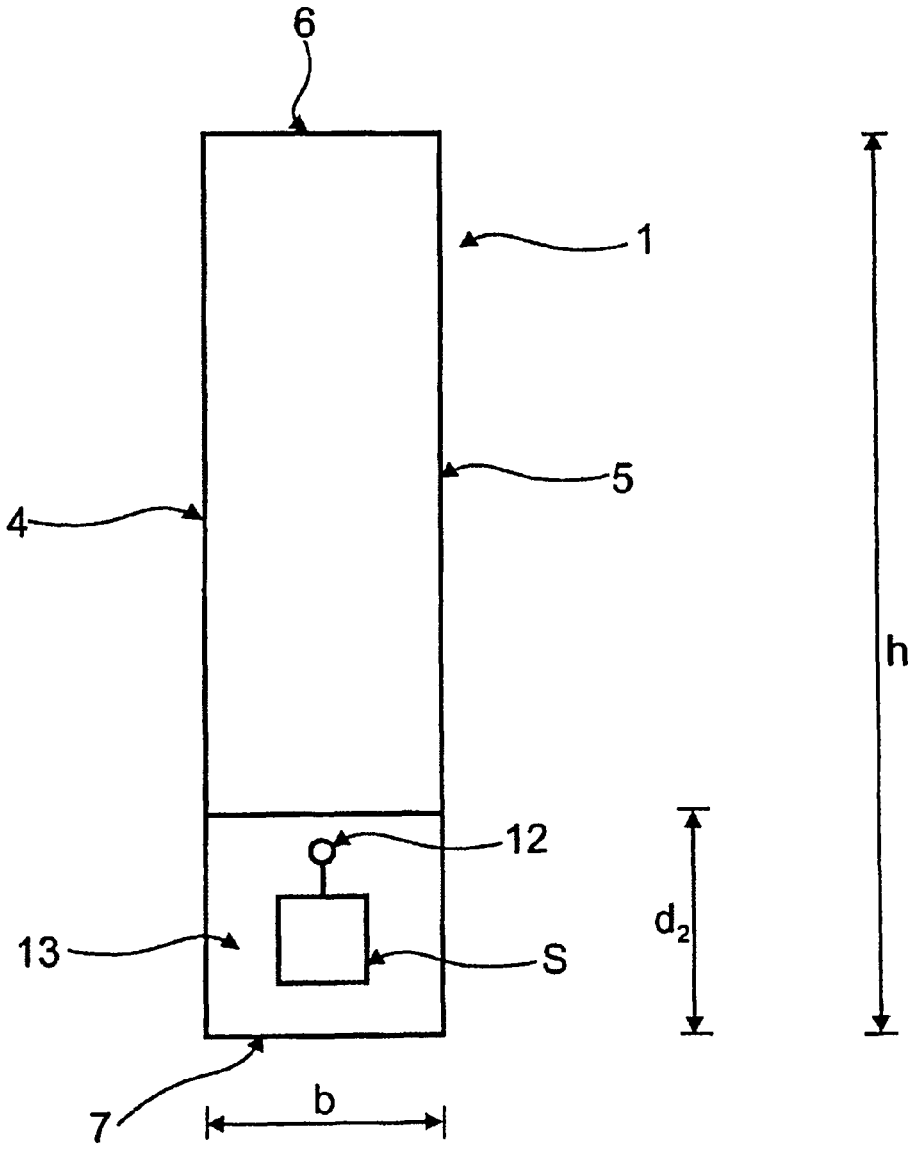
FIG. 2 provides a schematic of a cross-section of the apparatus of FIG. 1 through the line F1-F1.
Figure 3:
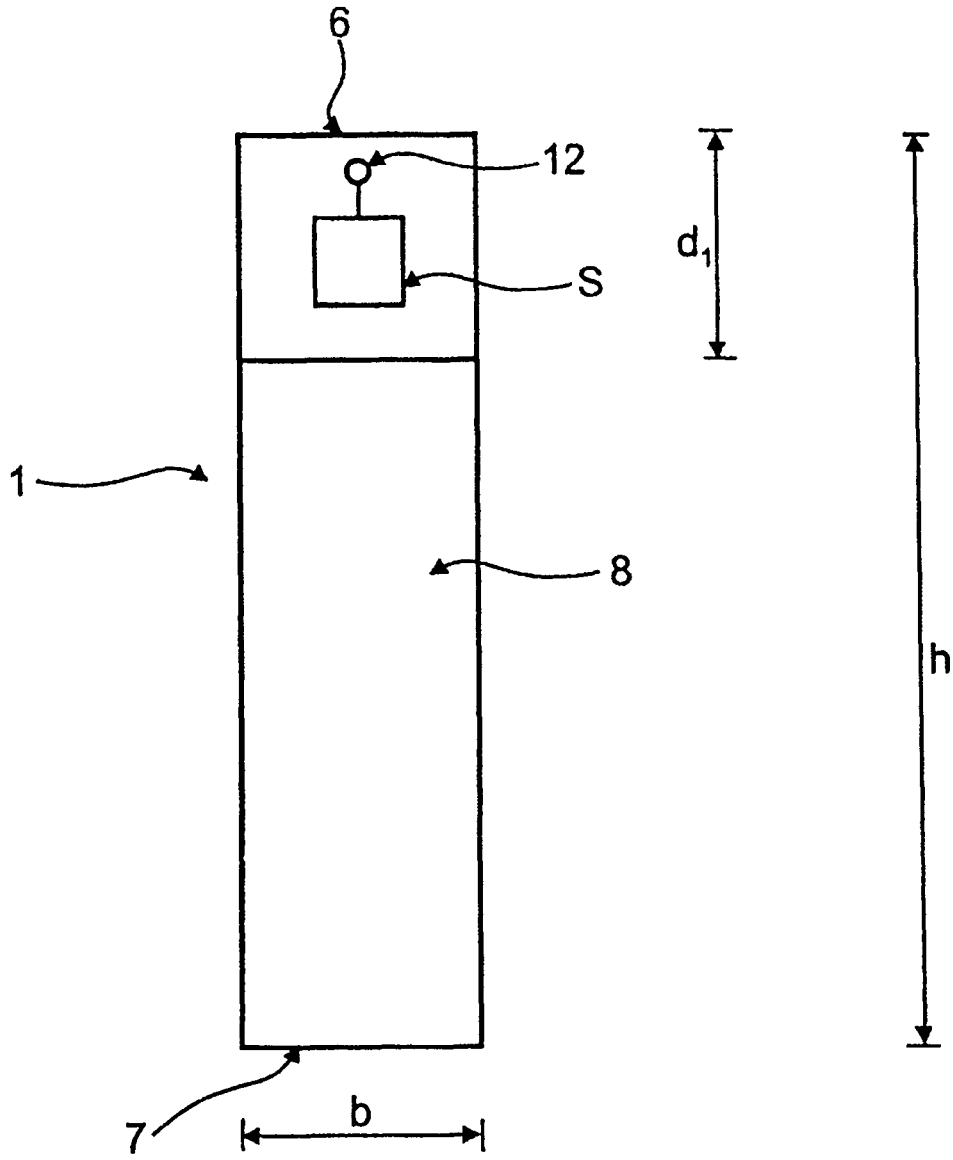
FIG. 3 provides a schematic of a cross-section of the apparatus of FIG. 1 through the line F2-F2.
Figure 4:
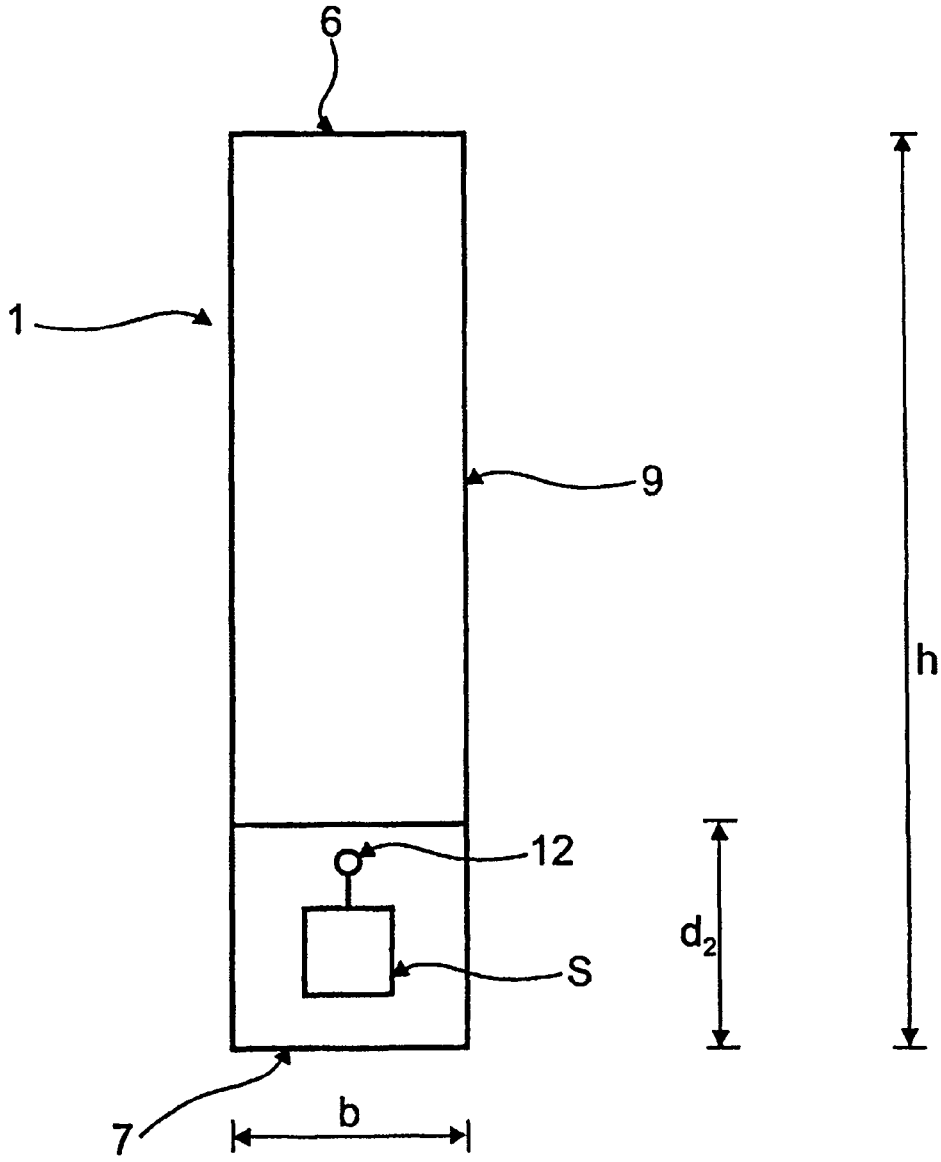
FIG. 4 provides a schematic of a cross-section of the apparatus of FIG. 1 through the line F3-F3.
Figure 5:
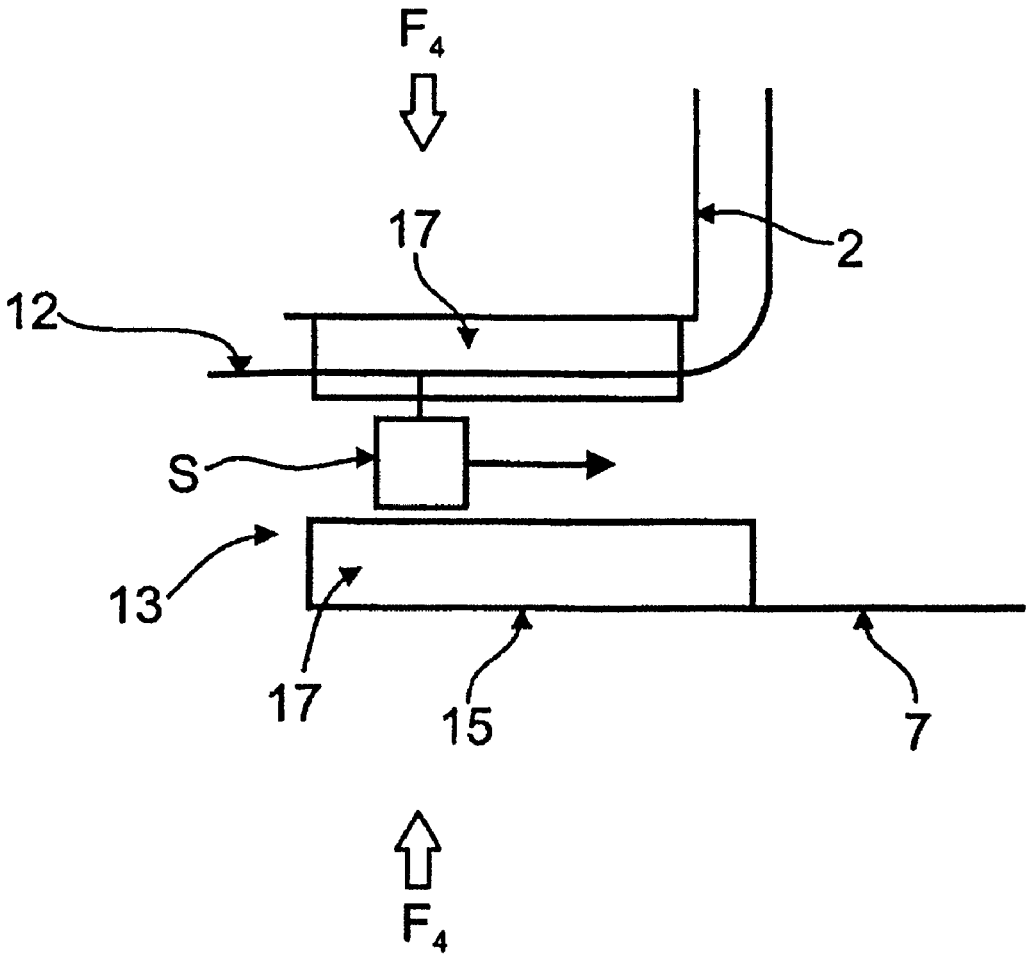
FIG. 5 provides a schematic of a further embodiment of an apparatus according to the present invention.
Figure 6:
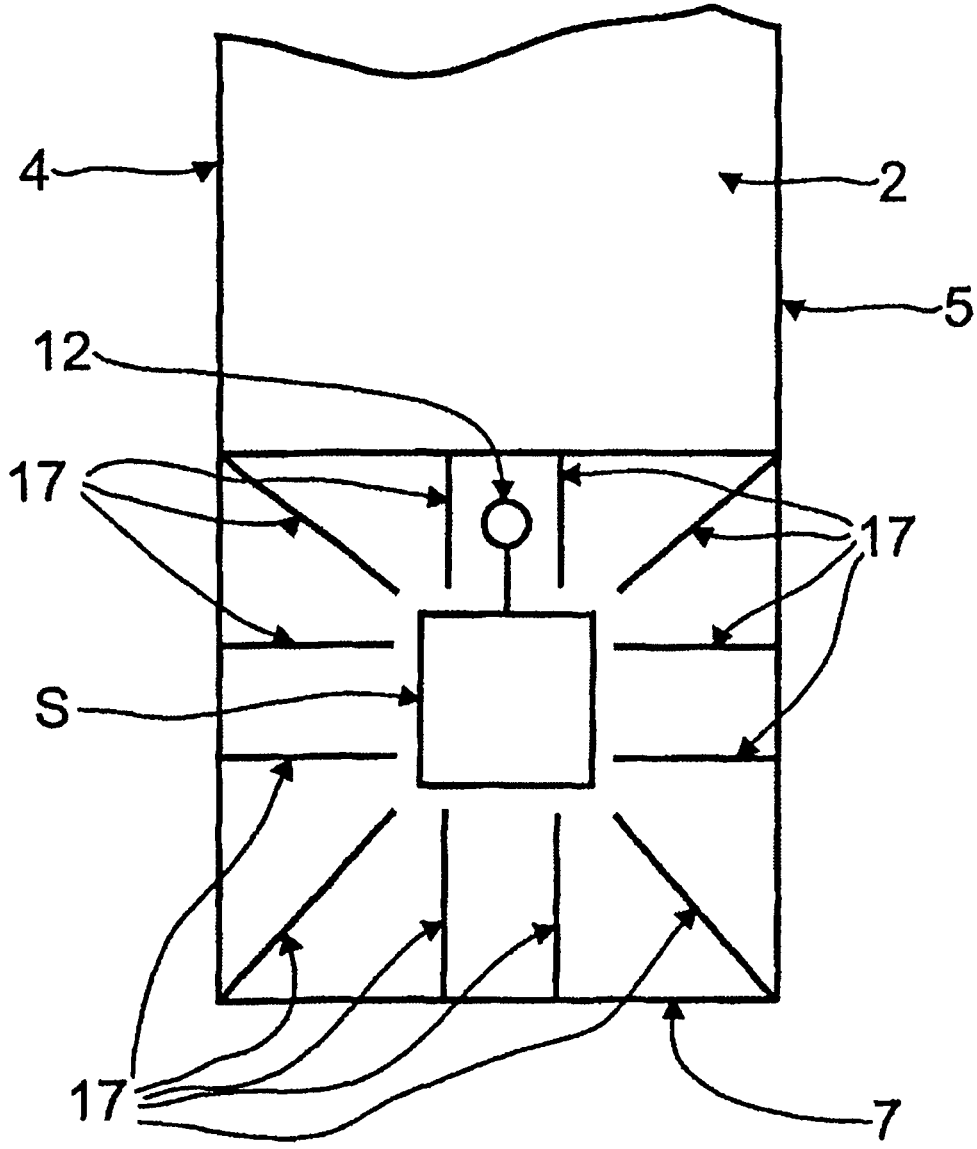
FIG. 6 provides a schematic of a cross-section of the apparatus of FIG. 5 through the line F4-F4.
Figure 7:
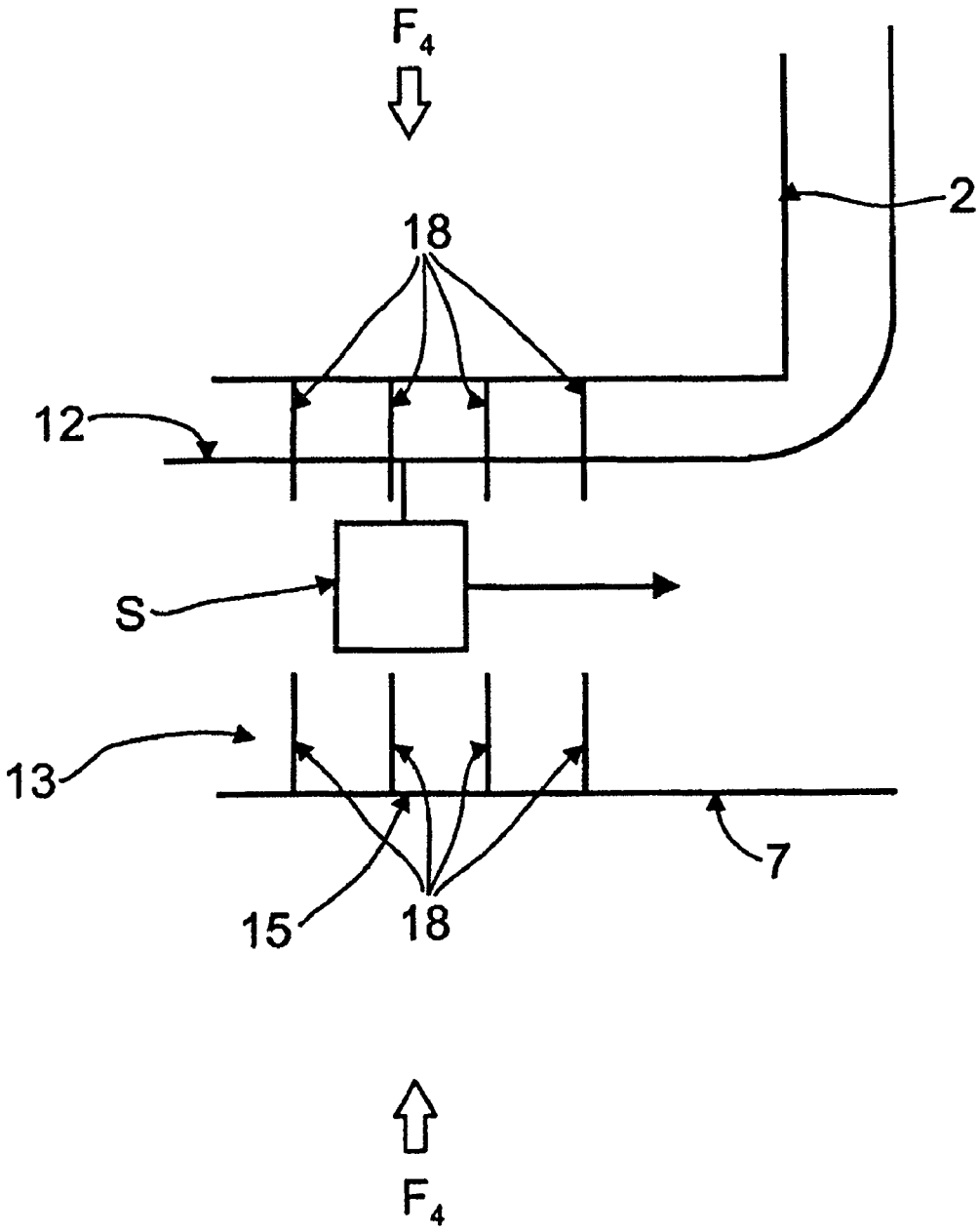
FIG. 7 provides a schematic of a further embodiment of an apparatus according to the present invention.
Figure 8:
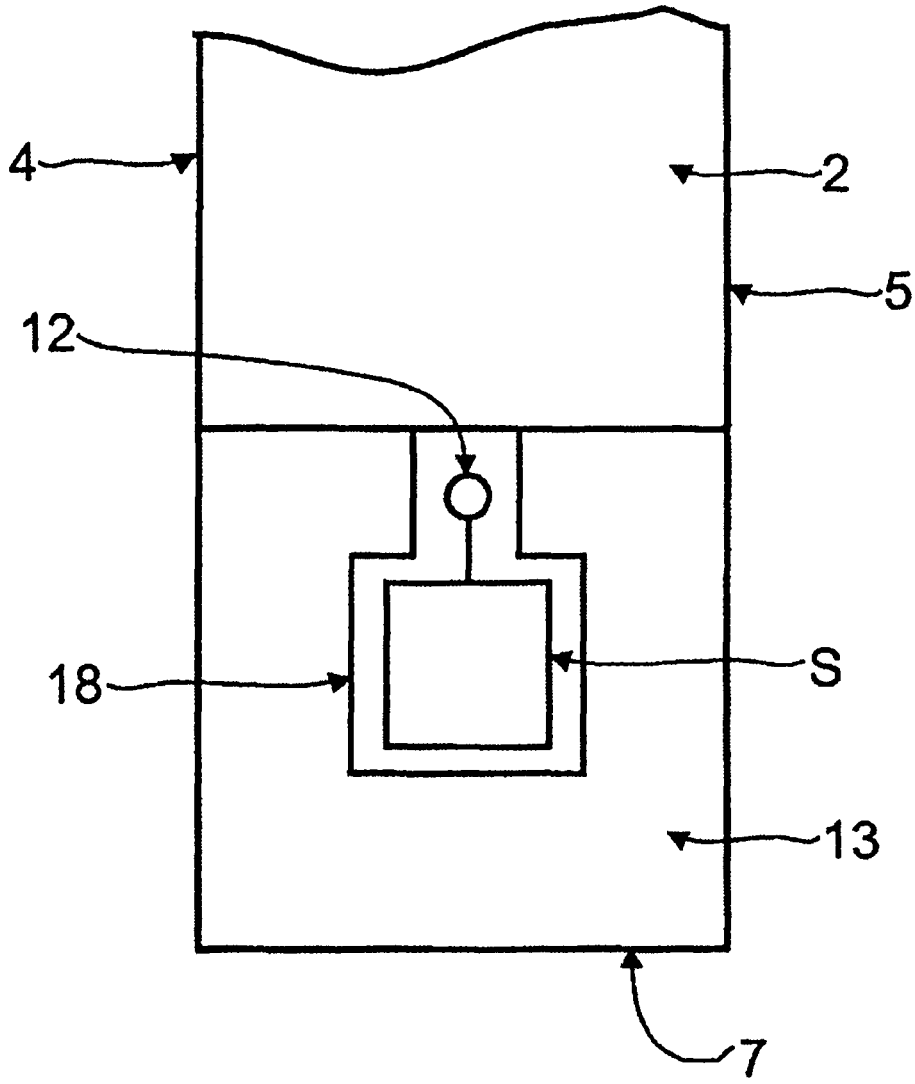
FIG. 8 provides a schematic of a cross-section of the apparatus of FIG. 7 through the line F4-F4.

In the apparatus of the invention it is possible to use inert gases which are heavier than air and also those which are lighter than air.

The molar weight of an inert gas heavier than air is therefore greater than 28.8 g/mol (corresponding to the molar weight of a gas mixture of 20% oxygen $O_2$ and 80% nitrogen $N_2$), preferably greater than 30 g/mol, more preferably at least 32 g/mol, in particular greater than 35 g/mol. Suitable examples include noble gases such as argon, and hydrocarbons with or without halogen. Particular preference is given to carbon dioxide.

The carbon dioxide feed may take place from pressure containers, filtered combustion gases, e.g., from natural gas or hydrocarbons, or, preferably, in the form of dry ice. A dry ice feed is seen as advantageous, especially for applications in the nonindustrial sector or the small industrial sector, since solid dry ice can be stored and transported as a solid in simple, foam-insulated containers. The dry ice can be used as it is, and is then in gaseous form at the usual temperatures of use. A further advantage of using dry ice is the cooling effect, which can be used for condensing and removing volatile paint components, such as solvents or water (see below).

Inert gases lighter than air are those having a molar weight of less than 28.8 g/mol, preferably of not more than 28.5 g/mol, more preferably of not more than 28.1 g/mol. Examples of such are molecular nitrogen, helium, neon, carbon monoxide, steam, methane or nitrogen/air mixtures (referred to as lean air); particular preference is given to nitrogen, steam and nitrogen/air mixtures, and very particular preference to nitrogen and nitrogen/air mixtures, especially nitrogen.

Inert gases which are lighter than air can be fed preferably from pressure vessels or from oxygen-depleted offgases, from oxidations or coking plant offgases, for example, or by separation of oxygen from gas mixtures, such as air or combustion gases, for example, using membranes.

The term "inert gas" in this text is used synonymously with "protective gas" and refers to compounds which on exposure to high-energy radiation show no substantial reaction with the coating materials and do not adversely affect the curing thereof in terms of rate and/or quality. The term comprehends in particular a low oxygen content (see below). "No substantial reaction" here means that under the exposure to high-energy radiation that is practised in the process the extent of reaction of the inert gases with the coating materials or with other substances present within the apparatus is less than 5 mol % per hour, preferably less than 2 mol % per hour, and more preferably less than 1 mol % per hour.

The inert gas (mixture) is charged to the apparatus and the air is displaced therefrom.

The apparatus now comprises an inert gas atmosphere into which the substrate which is coated with the radiation-curable composition, or the molding, can be guided. Subsequently the radiation cure can be carried out.

In the course of the radiation cure the average oxygen content ($O_2$) in the inert gas atmosphere should be less than 15% by volume, preferably less than 10% by volume, very preferably less than 8% by volume, more preferably less than 6% by volume, and in particular less than 3% by volume, based in each case on the total amount of gas in the inert gas atmosphere; with the method of the invention it is easily possible to adjust average oxygen contents to below 2.5% by volume, preferably below 2.0% by volume, and more preferably even below 1.5% by volume. This takes account of the particular difficulty that three-dimensional substrates entrain ("scoop") oxygen into the apparatus of the invention and that therefore the oxygen content is substantially more difficult to reduce than in the case of two-dimensional objects such as sheets, webs or the like, for example. Additionally, when guiding two-dimensional substrates through the apparatus of the invention, lower oxygen contents are achievable than in the case of three-dimensional substrates: for example, down to less than 1% by volume, preferably less than 0.5% by volume, more preferably less than 0.1% by volume, very preferably less than 0.05% by volume, and in particular less than 0.01% by volume.

By inert gas atmosphere is meant the gas volume during exposure to high-energy radiation, surrounding the substrate at a distance of up to 10 cm from its surface.

A further advantage of curing in an inert gas atmosphere is that the distances between lamps and radiation-curable material can be made greater as compared with curing in air. Overall it is possible to use lower radiation doses and one emitter unit can be used to cure larger areas.

Where dry ice is used as the inert gas it is easy, for example, to charge the apparatus, which may at the same time comprise storage containers for dry ice. The monitoring of carbon dioxide consumption can be determined directly from the consumption of the dry ice solid. Dry ice undergoes sublimation at −78.5° C. to form gaseous carbon dioxide directly. Within a tank, this process displaces atmospheric oxygen upward from the tank, with little eddying.

The residual oxygen can be determined with standard commercial atmospheric oxygen meters. Because of the oxygen-reduced atmosphere in the apparatus of the invention and the associated risk of suffocation, suitable safety measures ought to be taken. Similarly, adequate ventilation and inert gas dissipation ought to be ensured in adjacent working areas.

Apparatus 1 of the invention for effecting a cure of coatings on a substrate S under an inert gas atmosphere comprises

- side covers 2, 3, 4 and 5,
- top and bottom covers 6 and 7, with 2, 3, 4, 5, 6 and 7 together enclosing an interior,
- one or more dividing walls 8 which subdivide the interior, the dividing walls 8 finishing at the bottom cover 7 and leaving open a distance d1 from the top cover 6,
- one or more dividing walls 9 which subdivide the interior, the dividing walls 9 finishing at the top cover 6 and leaving open a distance d2 from the bottom cover 7,
- with 8 and 9, together with the respectively adjacent dividing wall 9 or 8 and, if appropriate, with the side covers 2 or 3, forming a subdivided interior (compartment),
- at least one radiation source 10 radiating within the interior and/or into the interior,
- at least one gas supply means 11, with which a gas or gas mixture can be passed into the interior or formed therein,
- at least one conveying means 12 for the substrate S,
- inlet 13 and
- outlet 14, where

- the dividing walls 8 stand substantially perpendicular to the bottom cover 7,
- the dividing walls 9 stand substantially perpendicular to the top cover 6,
- the distances d1 and d2 and also the breadth b of apparatus 1 being chosen such that they are greater than the dimensions of the substrate S along the conveying direction of the conveying means 12, and
- means 2, 3, 8 and 9 form at least 4 compartments.

One example of such apparatus is depicted in FIGS. 1 to 4.

The outer walls of the apparatus of the invention, namely front cover 2 and back cover 3, top cover 6 and bottom cover 7, and side covers 4 and 5 together enclose the interior of apparatus 1.

Together in each case with adjacent dividing walls 9 and 8 and, respectively, with the front or back cover 2 or 3 and also with the side covers 4 and 5 and the top and bottom covers 6 and 7, the dividing walls 8 and 9 of the apparatus of the invention enclose compartments which subdivide the entire interior of the apparatus. A compartment is formed by the walls surrounding it, which if necessary can be thought of as extended over free areas, in order to close any gaps: for example, in the case of the dividing walls 8, which for the conceptual construction of a compartment are thought of as extended up to the upper cover 6.

The number of compartments of the apparatus of the invention is at least 4, preferably at least 5, and more preferably at least 6. There is no limit in principle on the number of compartments, and it is preferably up to 15, more preferably up to 12, very preferably up to 10, and in particular up to 8.

The dividing walls 8 and 9 stand substantially perpendicular to the bottom cover 7 and top cover 6. This means essentially that the angle $\alpha 1$ enclosed by 8 and 7 and the angle $\alpha 2$ enclosed by 9 and 6 each differ by not more than 30° from the perpendicular, preferably not more than 20, more preferably not more than 15°, very preferably not more than 10°, in particular not more than 5°, and especially not at all; in the construction of the apparatus of the invention account should generally be taken of the usual margins of construction error.

The advantage of perpendicular conveying of this kind is that the apparatus of the invention is space-saving and takes up a very small floor space. At the same time, more-over, the apparatus allows simple shielding against UV radiation to the outside, so that radiation sources without filters, against UV-C radiation, for example, can be employed for efficient utilization of radiation.

Except for the deviation from the perpendicular described, the dividing walls 8 and 9 stand parallel to the front cover 2 and back cover 3, which in turn may likewise deviate from the perpendicular.

All of the components of the apparatus of the invention are connected to one another so that as little inert gas as possible escapes from the interior, apart from the entry 12 or the exit 13; in other words, any slits, gaps, slots or holes are sealed off.

The same is also true of the dividing walls, which, however, in the case of 8 need not be fixedly connected to the bottom cover 7 or, in the case of 9, need not be fixedly connected to the top cover 6, in order to allow the dividing walls to be displaced where appropriate. In this case a narrow gap may be tolerable between 8 and 7 and between 9 and 6, respectively, such a gap being preferably not more than 10 mm, more preferably not more than 7 mm, very preferably not more than 5 mm, in particular not more than 3 mm, and especially not more than 1 mm.

In contrast, the dividing wall 8 with the top cover 6 and the dividing wall 9 with the bottom cover 7, respectively, leave sufficient space for the substrate to be conveyed through this intermediate area. The intermediate area between 8 and 6 leaves the aperture d1, the intermediate space between 9 and 7 the intermediate space d2. The intermediate spaces d1 and d2 are designed so that they leave sufficient space for the dimensions of the substrate in the conveying direction of the conveying installation 12.

Naturally it is the case that, for the entire path through the apparatus of the invention along the conveying installation 12, sufficient space is left for the dimensions of the substrate in the conveying direction, without the substrate touching other components and/or substrates.

The substrate may in principle be conveyed in any orientation through the apparatus of the invention, preference being given to an orientation which minimizes the flow resistance and the eddying caused by the motion of the substrate. The cross-sectional area of the substrate that is projected in the conveying direction in this orientation is assumed in this text to be the area of the substrate. The dimensions present in this orientation of the substrate, as it is conveyed through the apparatus of the invention, are used in this text as the characteristic dimensions of the substrate.

The substrate is preferably conveyed through the apparatus of the invention such that its projected cross-sectional area perpendicular to the conveying direction is as small as possible or at least is not more than 25% more than this minimum, preferably not more than 20%, more preferably not more than 15%, very preferably not more than 10%, and in particular not more than 5%.

The cross-sectional area through which the substrate is conveyed through the individual compartments in the apparatus of the invention, in other words the area perpendicular to the conveying installation 12, ought in one preferred embodiment of the invention to be at least three times the projected cross-sectional area of the substrate in the conveying direction, preferably four times.

In another preferred embodiment of the invention the cross-sectional area ought to be not more than six times the area of the substrate, preferably not more than five times.

This cross-sectional area is, for example, the cross-sectional area Q1 which is left by the dividing walls 8 with the top cover 6—in other words, in the case of a square opening, the area d1·b—or the cross-sectional area Q2 left by the release walls 9 with the bottom cover 7—in other words, in the case of a square opening, the area d2·b—or the cross-sectional area Q3 formed between the dividing walls and, if appropriate, the walls 2 or 3—in other words, in the case of a square opening, the area d3·b.

The height h of the apparatus of the invention ought to be at least twice the diameter d1 or d2, depending on which diameter is the greater, and ought preferably to be at least three times said diameter.

In one preferred embodiment the dividing walls 8 and 9 are designed such that they can be displaced parallel to the top and bottom covers 6 and 7, in order to adapt the apparatus of the invention to different characteristic substrate dimensions.

Design possibilities of this kind are known per se to the skilled worker. By way of example the dividing walls can be displaced in guide rails or fixed in seats or accommodation means in the side covers and/or top and bottom covers.

In another preferred embodiment the dividing walls 8 and 9 are of a design such that the distance d1 or d2 from the bottom or top covers 7 or 6 respectively can be altered in order to adapt the apparatus of the invention to different characteristic substrate dimensions.

Design possibilities of this kind are known per se to the skilled worker. By way of example it is possible for two or more dividing walls to be disposed telescopically with one another to allow shortening or extension by being pulled out.

The distances d1, d2, d3 and b are preferably chosen such that the distances between substrate and walls are as far as possible the same, in order to ensure maximum uniformity of flow circulation around the substrate in the inert atmosphere. The cross-sectional area which is formed as a result may be circular, oval, ellipsoidal, quadrilateral, trapezoidal, rectangular, square or irregular in shape. For the sake of simplicity the cross-sectional area chosen is preferably quadrilateral and with particular preference is rectangular or square.

Entry 13 and exit 14 may consist for the sake of simplicity merely as openings in the front cover 2 or back cover 3 or else, if appropriate, in a side cover 4 or 5. Naturally, entry 13 and exit 14 can also be made in the top cover 6 or bottom cover 7.

In one preferred embodiment entry 13 and/or exit 14 are of prolonged configuration, so that the substrate is conveyed a section 15 of length f1 through the entry 13 and/or a section 16 of length f2 through the exit 14. These sections f1 and/or f2 may, for example, be from 0 to 10 times the parameters d1 or d2, depending on which of these two parameters is the greater; preferably 0 to 5 times, more preferably 0 to 2 times, very preferably 0.5 to 2 times, and in particular 1 to 2 times (FIG. 1).

In a further preferred embodiment entry 13 and/or exit 14 are configured such that the substrate is surrounded as closely as possible. This can be achieved, for example, by the openings of entry and/or exit reaching as close as possible the dimensions of the substrate and not, as required above, forming a multiple of the substrate cross-section. If entry and/or exit are of prolonged configuration then the cross-sectional area of the prolonged configuration may taper in the entry or exit direction, respectively.

In another preferred embodiment entry 13 and/or exit 14 are provided with means which reduce fluid discharge of the inert gas present in the apparatus from entry or exit, respectively. Since the substrate at the entry is generally covered with an uncured coating material, which is consequently tacky, means of this kind should not contact the substrate at the entry.

Examples of suitable means are baffles, brushes, curtains, curtain strips, fine-mesh nets, springs, doors, sliding doors or airlocks. It is also possible, if desired, to arrange two or more of these means one behind another. Also suitable are ponds at the entries and/or exits. Ponds are basins which comprise inert gas and whose purpose is to separate zones of eddying air from the irradiation zone. For that purpose the inert gas basin can be extended, starting from the exposure zone, both in terms of height and in terms of breadth, on both sides. The dimensions of the ponds are dependent primarily on the speed of immersion and emersion and on the geometry of the substrate.

Where both entry and exit have been provided with such means it is a preferred embodiment to open and to close entry and exit, respectively, simultaneously, using said means. In other words, at the same time as one substrate is passing the entry and the means at that point—a door, sliding door, baffle or airlock, for example—is opened, a cured substrate passes the exit and the means at that point is likewise opened.

If, however, the apparatus of the invention has been set up at a draughty site, then it may be preferred to close entry and exit in alternation, since in that way a draught through the apparatus of the invention can be avoided.

In a further preferred embodiment, entry and/or exit may also be provided with means which lessen turbulences or flows. These may be, for example, metal guide plates 17 or guide grids, arranged along the conveying direction, two or more fine-meshed nets arranged one behind another, or metal guide plates 18 disposed transverse to the conveying direction, and preferably adapted as closely as possible to the substrate cross-section (FIGS. 5 to 8).

In one preferred embodiment of the invention, when using an inert gas lighter than air, entry 13 and/or exit 14 of the apparatus of the invention are sited in the lower half of the apparatus, relative to the height h of the apparatus, more preferably in the lower third, and very preferably as far down as possible or in the bottom cover 7 (FIG. 1).

Figure 9:
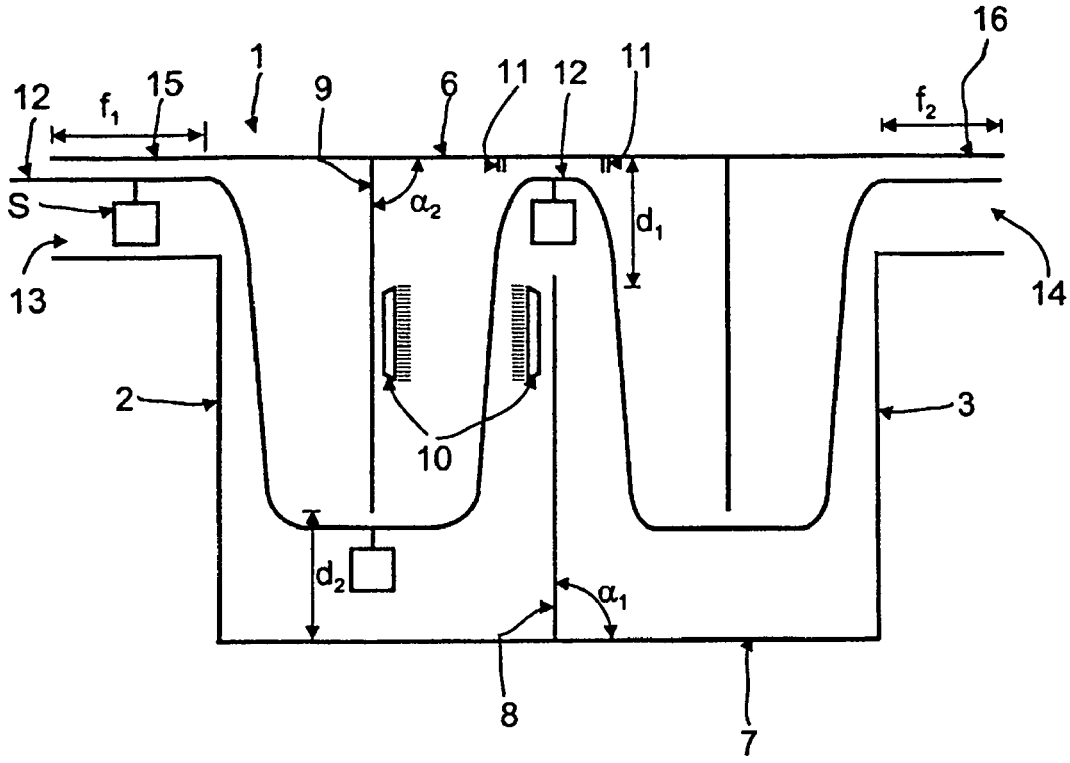
FIG. 9 provides a schematic of an additional preferred embodiment of an apparatus according to the present invention.

In one preferred embodiment of the invention, when using an inert gas heavier than air, entry 13 and/or exit 14 of the apparatus of the invention are sited in the upper half of the apparatus, relative to the height h of the apparatus, more preferably in the upper third, and very preferably as far up as possible or in the top cover 6 (FIG. 9).

The purpose of the conveying mechanism 12 is to convey the substrate S through the apparatus. Such conveying mechanisms are known per se and are not critical to the invention. The conveying mechanism may be arranged through the apparatus above, below or to the side of the substrate. In one preferred embodiment the substrate is moved through the apparatus by means of a conveying mechanism disposed on one or both sides. This has the advantage that no abraded material from the conveying mechanism falls onto the substrate, which if appropriate has not yet been cured.

The substrate may be conveyed, for example, on belts, chains, cables or rails. If desired, the substrate may also rotate within the apparatus of the invention, though this is less preferable in accordance with the invention.

Where objects other than three-dimensional objects are conveyed through the apparatus of the invention, examples being fibers, films or floor coverings, then the conveying installation 12 may be composed of rollers and/or rolls, over which the substrate is conveyed.

The apparatus of the invention includes at least one radiation source 10.

The radiation cure can be carried out using electron beams, X-rays or gamma rays, NIR, IR and/or UV radiation or visible light. It is an advantage of the cure of the invention under an inert gas atmosphere that the radiation cure is able to take place with a wide diversity of radiation sources, including those of low intensity.

Radiation sources which can be used in accordance with the invention are those which have the capacity to emit high-energy radiation. High-energy radiation in this context is electromagnetic radiation in the spectral NIR, VIS and/or UV range and/or electron beams.

NIR radiation here denotes electromagnetic radiation in the wavelength range from 760 nm to 2.5 μm, preferably from 900 to 1500 nm.

UV radiation or daylight comprises light in the wavelength range of $\lambda$=200 to 760 nm, more preferably $\lambda$=200 to 500 nm, and very preferably $\lambda$=250 to 430 nm.

The radiation dose normally sufficient to cure coating material in the case of UV curing is in the range from 80 to 5000 mJ/cm$^2$.

Electron beams comprise irradiation with high-energy electrons (150 to 300 keV).

Preferred in accordance with the invention are NIR and/or UV radiation and, with particular preference, radiation with wavelengths below 500 nm. Especial preference is given to radiation with a wavelength below 500 nm which within an exposure time of 10 seconds produces an exposure dose on the substrate of more than 100 mJ/cm$^2$ of substrate surface area.

Suitability is possessed by lamps which exhibit a linear spectrum, in other words, which emit only at certain wavelengths, examples being light-emitting diodes or lasers.

Likewise suitable are lamps with a broad band spectrum, in other words a distribution of the emitted light over a wavelength range. Intensity maxima in this case are preferably in the range below 430 nm.

Examples of suitable radiation sources for the radiation cure are low-pressure, medium-pressure and high-pressure mercury lamps and also fluorescence tubes, pulsed emitters, metal halide emitters, electronic flash devices, which allow radiation curing without a photoinitiator, or excimer emitters. Mercury emitters may be doped with gallium or iron.

As far as the method of the invention is concerned, the radiation cure may also be carried out with daylight or with lamps which act as a daylight substitute. These lamps emit in the visible range above 400 nm and as compared with UV lamps have little if any UV light component. Examples that may be mentioned include incandescent lamps, halogen lamps, and xenon lamps.

Likewise suitable are pulsed lamps, examples being photographic flash lamps or high-power flash lamps (from VISIT). A particular advantage of the method is the capacity to use lamps with a low energy demand and a low UV component, such as 500 watt halogen lamps, for example, such as are employed for general illumination purposes. As a result there is no need either for a high-voltage unit for current supply (in the case, of mercury vapor lamps) or, if appropriate, for light protection measures. Additionally, with halogen lamps, even in air, there is no hazard due to evolution of ozone, as in the case of shortwave-emitting UV lamps. This facilitates radiation curing with portable irradiation devices and gives rise to the possibility of applications "in situ", i.e., independent of fixed industrial curing units.

The number of radiation sources which can be used for the cure is arbitrary, and these sources may each be identical to or different from one another.

If appropriate, an arrangement of the radiation sources that is adapted to the substrate geometry and to the conveying speed is also possible, in order deliberately to expose certain areas more intensively.

In order to expose difficult-to-reach areas, particularly of three-dimensional substrates, it is conceivable for at least some of the radiation sources and/or at least some of any reflectors present to be implemented in a movable form, such as on robot arms, for example, so that even, for example, shadow areas within substrates can be exposed.

It may also be useful to treat the substrate, in the course of its passage through the apparatus of the invention, first with NIR radiation and thereafter with UV radiation.

The period of irradiation depends on the desired degree of cure of the coating or molding. At its most simple, the degree of curing can be determined from the loss of tack or from the scratch resistance, to the fingernail, for example, or to other objects such as pencil leads, metal tips or plastic tips. Also suitable are tests which are customary in the coatings field for resistance to chemicals, e.g., solvents, inks, etc. Without damage to the coating surfaces, suitability is possessed in particular by spectroscopic methods, especially Raman and infrared spectroscopy, or measurements of the dielectric or acoustic properties, etc.

Since the radiation sources generally give off a large quantity of heat, which can be damaging to temperature-sensitive substrates, it may be useful to site the radiation sources not completely within the interior of the apparatus of the invention but rather in such a way that cooling means for the radiation sources are sited outside the apparatus of the invention and the radiation sources emit light into the apparatus of the invention.

This can be achieved, for example, by setting the radiation sources into the top cover 6 or bottom cover 7 and/or into the side covers 4 and/or 5 and locating the housings and/or cooling units outside the apparatus of the invention.

In one preferred embodiment of the invention the radiation sources are sited completely within the apparatus of the invention, so that the heat given off can be utilized, if appropriate, for drying of the coating material on the substrate (see below).

Moreover, in order to increase the degree of utilization of the high-energy radiation, there may be one or more reflectors sited in the apparatus of the invention, examples being mirrors, aluminum or other metal foils or bright metal surfaces. In one preferred embodiment the surfaces of the walls or covers 2, 3, 4, 5, 6, 7, 8 and/or 9 may themselves be configured as reflectors.

Relative to the overall path length of the conveying installation through the apparatus of the invention, the at least one radiation source 10 may be positioned within the apparatus of the invention preferably in the range from 25% of the overall path length up to 80% of the overall path length, more preferably in the range from 33% up to 75% of the overall path length, very preferably in the range from 40% up to 75%, and in particular in the range from 50% up to 75% of the overall path length.

These figures relate to the path length of the conveying installation through the apparatus of the invention: in other words, at the entry this path length is 0%, at the exit it is 100%, and in the middle is 50% of the overall path length.

The at least one radiation source may also be distributed over a wide area, thereby forming a zone within which irradiation takes place.

Figure 10:
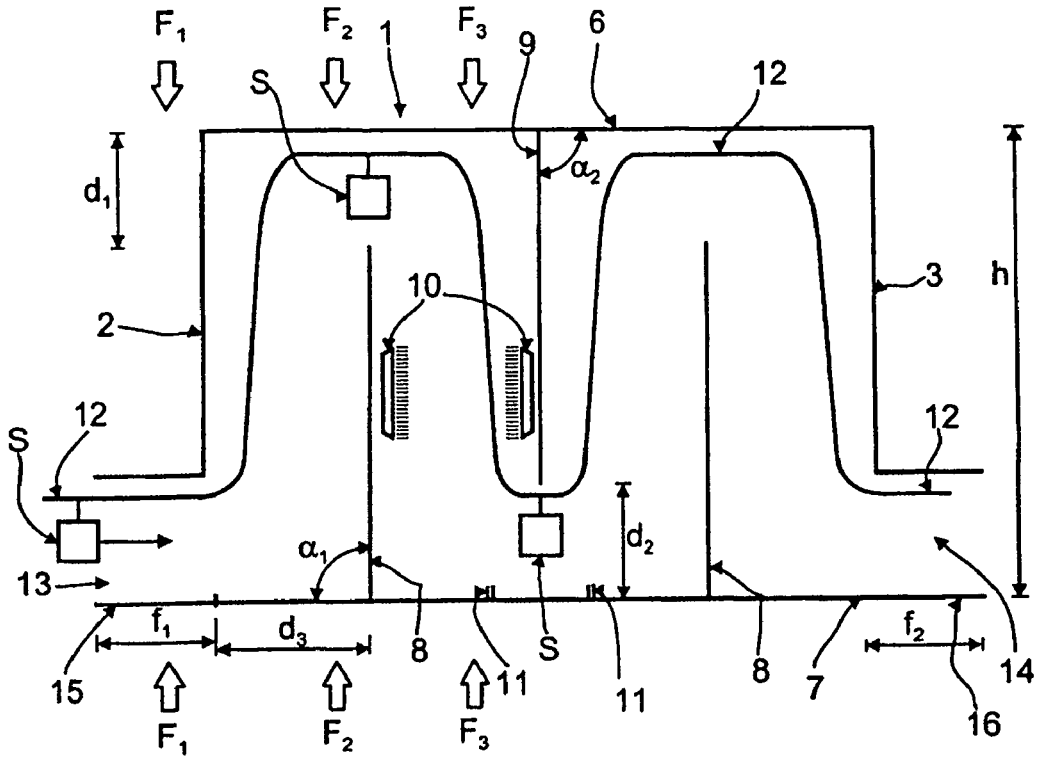
FIG. 10 provides a schematic of an additional preferred embodiment of an apparatus according to the present invention.

In one particularly preferred embodiment at least one radiation source 10 is located upstream of the gas supply means 11, as viewed in the conveying direction of the conveying installation 12, and with very particular preference at least one radiation source 10 is located on the side covers 4 and/or 5 and/or on the dividing walls 8 and/or 9 (FIG. 10).

The effect of this is that the flow of the inert gas, at least between the entry 13 and the gas supply means 11, extends preferably countercurrent to the conveying direction of the conveying installation 12.

The inert gas may in principle be metered into the apparatus of the invention at any desired location, by at least one gas supply means 11.

The flow of the inert gas may in principle move in cocurrent or in countercurrent relative to the conveying direction of the conveying installation 12, the inert gas preferably being metered in such that the flow of the inert gas between entry 13 and the section in which radiation curing of the substrate takes place moves in countercurrent to the conveying direction.

The inert gas is preferably metered in in the area around and/or after the last radiation source, more preferably within a quarter of the overall path length of the conveying installation through the apparatus of the invention, upstream and/or downstream of the zone within which irradiation takes place; with very particular preference, in the range of up to 15% of the overall path length upstream and up to 25% downstream of the zone in which irradiation takes place; and, in particular, in the range of up to 5% of the overall path length upstream and up to 15% downstream of the zone within which irradiation takes place.

With the gas supply means 11 a gas or gas mixture can be guided into the interior or formed therein. The latter possibility is of interest, for example, if the inert gas is introduced in solid form, as dry ice for example, or in liquid form, as condensate, for example, or under pressure, into the apparatus of the invention and then sublimes or evaporates therein.

In one preferred embodiment of the invention the inert gas is passed into the apparatus of the invention with little flow or eddying, by means for example of flow harmonizers or flow rectifiers, such as perforated metal plates, screens, sintered metal, grids, frits, beds, honeycomb structures or tube structures, preferably perforated metal plates or grids. Flow harmonizers or flow rectifiers of this kind reduce nonperpendicular flow impingement or swirling.

The amount of inert gas added is adapted in accordance with the invention so as to compensate the inert gas lost through any leaks or through the entry and/or exit. The aim is of course to minimize the consumption of inert gas. In general, with the apparatus of the invention, the level of metered addition of inert gas to compensate the loss of inert gas, plus the inert gas volume displaced and carried out via the conveyed material, is not more than two times the internal volume of the apparatus of the invention per hour, more preferably not more than one times the internal volume, very preferably not more than 0.5 times the internal volume, and in particular not more than 0.25 times the internal volume of the apparatus of the invention per hour.

In one preferred embodiment of the present invention, when using an inert gas which is lighter than air, the inert gas is supplied via a gas supply means 11 in the upper third of the apparatus of the invention, relative to its height h, more preferably in the upper quarter, and with very particular preference in the top cover 6.

In another preferred embodiment of the present invention, when using an inert gas lighter than air, the inert gas is heated before, during or after its metered addition via a gas supply means 11, the inert gas being heated for example to a temperature which corresponds at least to the temperature of the inert gas atmosphere, more preferably to a temperature which is at least 10° C. above the temperature of the inert gas atmosphere, and with very particular preference to a temperature which is at least 20° C. above the temperature of the inert gas atmosphere.

In one preferred embodiment of the present invention, when using an inert gas which is heavier than air, the inert gas is supplied via a gas supply means 11 in the lower third of the apparatus of the invention, relative to its height h, more preferably in the lower quarter, and with very particular preference in the bottom cover 7.

In another preferred embodiment of the present invention, when using an inert gas heavier than air, the inert gas is cooled before, during or after its metered addition via a gas supply means 11, the inert gas being cooled for example to a temperature which is below the temperature of the inert gas atmosphere, more preferably to a temperature which is at least 10° C. below the temperature of the inert gas atmosphere, and with very particular preference to a temperature which is at least 20° C. below the temperature of the inert gas atmosphere.

It is a further preferred embodiment of the invention to use nitrogen and carbon dioxide simultaneously as inert gases in the apparatus of the invention, with nitrogen being supplied via a gas supply means 11 in the upper third of the apparatus of the invention, relative to its height h, more preferably in the upper quarter, and very preferably in the top cover 6, and carbon dioxide being supplied via a gas supply means 11 in the lower third of the apparatus of the invention, relative to its height h, more preferably in the lower quarter, and very preferably in the bottom cover 7. In a further version of this embodiment the nitrogen may be heated as described above and/or the carbon dioxide may be metered in after cooling as described above. In this way it is possible to achieve, by overlaying, a density gradient of the inert gases within the apparatus of the invention.

In one preferred embodiment the side covers 2, 3, 4 and/or 5 and also the top and bottom covers 6 and/or 7 are thermostated or insulated, in order to minimize temperature compensation between the apparatus of the invention and its environment. Temperature compensation via the outer walls could give rise to unwanted convection currents within the apparatus.

The apparatus of the invention may of course have one or more manholes or access ports, through which the interior is accessible, in order, for example, to move dividing walls, to alter the distances d1 and/or d2 or to replace lamps. Before the apparatus is entered it is vital on workplace safety grounds to remove the inert gas from the interior and to switch off the radiation sources.

Application, film forming, evaporation of diluents and/or thermal preliminary reactions of the coating material take place normally outside the apparatus of the invention.

Generally speaking, the time interval or physical distance separating application from the apparatus of the invention, or the way in which application takes place, are irrelevant to the invention.

Application may take place to the substrate by means, for example, of spraying, troweling, knifecoating, brushing, rolling, roller coating, pouring, laminating, dipping, flooding, spreading, etc. The coating thickness is generally in a range from about 3 to 1000 g/m$^2$ and preferably 5 to 200 g/m$^2$.

In one particularly preferred embodiment of the invention the substrate coated with a coating material is dried at least partly within the apparatus of the invention: that is, volatile constituents of the coating material are removed very largely within the apparatus. Volatile constituents of this kind may, for example, comprise solvents present in the coating material. These may be, for example, esters, such as butyl acetate or ethyl acetate, aromatic or (cyclo)aliphatic hydrocarbons, such as xylene, toluene or heptane, ketones, such as acetone, iso-butyl methyl ketone, methyl ethyl ketone or cyclohexanone, alcohols such as ethanol, isopropanol, mono- or lower oligo-ethylene or -propylene glycols, mono- or dietherified ethylene or propylene glycol ethers, glycol ether acetates, such as methoxypropyl acetate, cyclic ethers such as tetrahydrofuran, carboxamides such as dimethylformamide or N-methylpyrrolidone, and/or water, for example. Vaporization and/or evaporation of solvents in the drying step within the apparatus of the invention have the advantage that the gaseous solvents contribute to the inert atmosphere within the dust-free apparatus, which reduces the consumption of inert gas, and additionally exerts a plasticizer effect on the coating in the course of curing, as a result of which the coating becomes more flexible. It is therefore of advantage in accordance with the invention if the inert gas atmosphere present within the apparatus of the invention has a solvent fraction, encompassing one or more solvents, of at least 2.5% by volume, preferably at least 5%, more preferably at least 7.5%, and very preferably at least 10% by volume.

Figure 11:
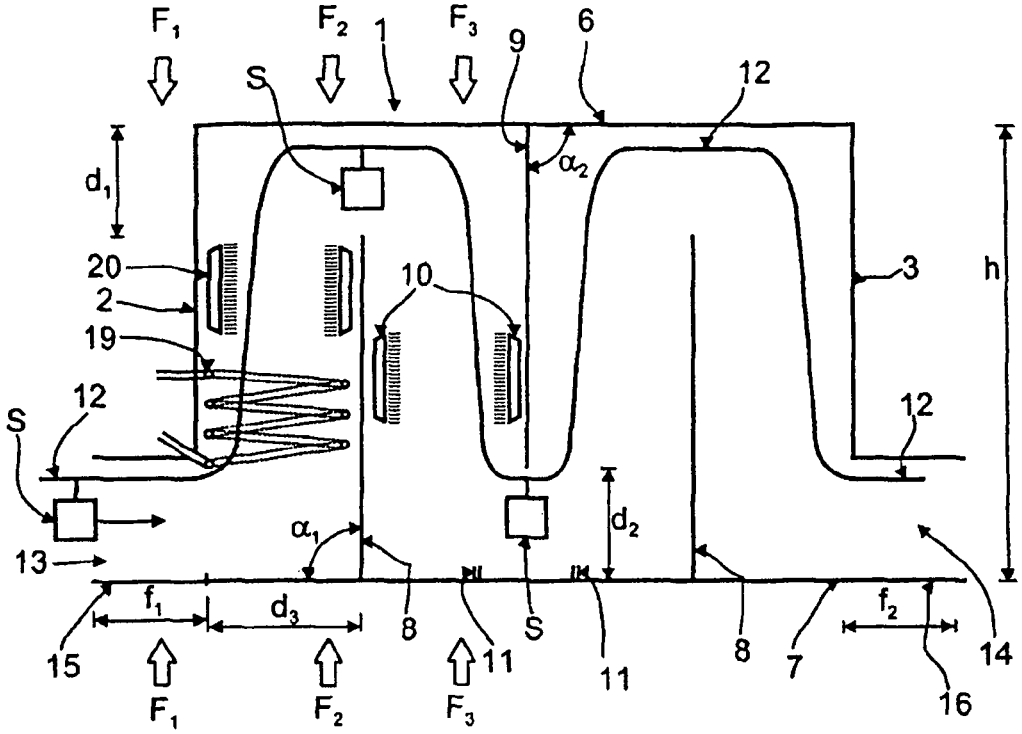
FIG. 11 provides a schematic of a further preferred embodiment of an apparatus according to the present invention.

In a further particularly preferred embodiment the apparatus of the invention additionally comprises a condensation facility 19 (FIG. 11), in which the solvents within the inert gas atmosphere inside the apparatus of the invention can be condensed. Condensation facilities of this kind are located preferably at the entry and/or exit of the apparatus of the invention. They may comprise cooling fingers, cooling coils or plate heat exchangers or tube bundle heat exchangers, situated within the apparatus, which are operated either with an external cooling medium in co- or counter-current, preferably in counter-current relative to the conveying direction of the substrate, or preferably, where dry ice is used as a source of $CO_2$ inert gas within the apparatus, with dry ice, thereby generating inert gas within the apparatus at the same time and allowing the solvent to be recovered. The condensate is then collected and conveyed outside of the apparatus, by means of a hydraulic jack, outflow channel or drain, with a siphon if appropriate. Such condensation and, if appropriate, recycling of the solvent distinctly reduce the emissions and also the consumption of solvent.

To dry the coating material on the coated substrates within the apparatus of the invention the inert gas atmosphere and/or the coating material is heated over a period of at least 1 minute, preferably at least 2 minutes, more preferably at least 3 minutes, and very preferably at least 5 minutes, at a temperature of at least 50° C., preferably at least 60° C., more preferably at least 70° C., and very preferably at least 80° C.

The heat for the drying can be introduced, for example, by utilizing the heat given off by the at least one radiation source 10 or by way of at least one additional heating means 20, located between entry and irradiation of the coated substrates. Heating means 13 of this kind are known per se to the skilled worker, and preferably comprise IR and/or NIR lamps, which heat the coating material. NIR radiation here is electromagnetic radiation in the wavelength range from 760 nm to 2.5 μm, preferably from 900 to 1500 nm, and IR radiation is in the wavelength range of 25-1000 μm (far IR) and preferably 2.5-25 μm (middle IR). Drying is preferably carried out using radiation having a wavelength of 1 to 5 μm.

In one preferred embodiment the radiation cure is effected at least partly and preferably completely when the coating material on the coated substrates has a temperature of 50° C. or more, preferably of at least 60° C., more preferably of at least 70° C., and very preferably of at least 80° C. It is of minor importance here how the coating material is brought to said temperature—whether by heating of the inert gas atmosphere and/or by radiation sources 10 and/or by additional heating means 20 and/or otherwise.

If the radiation cure is effected at least partly at such an elevated temperature of the coating material, then better properties are found for the resulting coating. The reason for this is unclear; it might for example lie in the reduced viscosity of the heated coating material.

The residence time within the apparatus is dependent on whether additional drying is to take place within the apparatus of the invention or not. Normally the residence time without drying within the apparatus of the invention, in other words from the passage of the substrate through the entry to the passage through the exit, is at least one minute, preferably at least 2 minutes, more preferably at least 3 minutes, very preferably at least 4 minutes, and in particular at least 5 minutes. The residence time without drying within the apparatus of the invention generally does not exceed 15 minutes, and preferably is not more than 12 minutes, more preferably not more than 10 minutes, very preferably not more than 9 minutes, and in particular not more than 7 minutes. A higher residence time generally has no deleterious effect on the curing of the coating material, but also has no positive effect, and so results in unnecessarily large apparatus.

Where the apparatus of the invention comprises additional drying, then of course the drying time must be added to the indicated residence time.

The length of the conveying installation 12 through the apparatus of the invention, and the speed at which the substrate is conveyed, are adapted correspondingly to this residence time. The residence time of the substrate in the apparatus depends, for example, on the substrate, and also on its size, weight and the complexity of its structure, and also on the reactivity, nature (pigmentation, for example), amount, thickness, and surface area of the coating material to be cured and/or of the coating comprising it on the substrate.

The rate at which three-dimensional objects are conveyed through the apparatus of the invention may be for example 0.5 to 10 m/min, preferably 1-10 m/min, more preferably 2-8 m/min, very preferably 3-7 m/min, and in particular 5 m/min. Objects with parts which scoop up gas, such as trim parts or housings for vehicles or machines, are conveyed at similar speeds, but require additional measures to reduce the entrainment of oxygen, in particular by means of extended path sections.

Three-dimensional objects are those whose coating with a coating material cannot be cured by direct irradiation from precisely one radiation source, or at least not theoretically.

For web products, such as films or floor covering, for example, the conveying rate can be up to more than 100 m/min and, for the fibers, up to more than 1000 m/min. In these cases the conveying installation 12 may comprise, for example, rollers and/or rolls.

It may be useful to provide two or more parallel conveying installation within the apparatus, which convey the substrates through a common entry and exit in each case but follow separate sections within the apparatus. This has the advantage that the number of entries and exits, through which the majority of inert gas is lost, is kept as low as possible.

In order to avoid inert gas losses the apparatus of the invention should be set up in a draught-free site, since even a gentle flow around the apparatus may draw inert gas from the apparatus of the invention. On safety grounds, however, adequate ventilation of the site of the apparatus must be ensured, in order to prevent inertization of the environment, which could pose a hazard to the operative personnel.

To minimize the inert gas demand of the apparatus of the invention it is possible to reduce air flows which are present as a result of exchange of air by application and drying installations, by maintaining a distance, accordingly, from these application and drying installations or by interrupting or diverting these air flows with—for example—shielding walls.

Radiation-curable coating materials comprise radiation-curable compounds as binders. These are compounds containing free-radically or cationically polymerizable ethylenically unsaturated groups. The radiation-curable material comprises preferably 0.001 to 12, more preferably 0.1 to 8, and very preferably 0.5 to 7 mol of radiation-curable ethylenically unsaturated groups per 1000 g of radiation-curable compounds.

Examples of suitable radiation-curable compounds include (meth)acrylic compounds, vinyl ethers, vinyl amides, unsaturated polyesters, based for example on maleic acid or fumaric acid if appropriate with styrene as reactive diluent, or maleimide/vinyl ether systems.

Preference is given to (meth)acrylate compounds such as polyester (meth)acrylates, polyether (meth)acrylates, urethane (meth)acrylates, epoxy (meth)acrylates, carbonate (meth)acrylates, silicone (meth)acrylates, and acrylated polyacrylates.

Preferably at least 40 mol % and more preferably at least 60% of the radiation-curable ethylenically unsaturated groups are (meth)acrylic groups.

The radiation-curable compounds may comprise further reactive groups, examples being melamine, isocyanate, epoxy, anhydride, alcohol, and carboxylic acid groups, for an additional thermal cure (dual cure), by chemical reaction, for example, of alcohol, carboxylic acid, amine, epoxy, anhydride, isocyanate or melamine groups.

The radiation-curable compounds may be present in the form, for example, of a solution, in an organic solvent or water, for example, as an aqueous dispersion, or as a powder.

The radiation-curable compounds and hence also the radiation-curable materials are preferably fluid at room temperature. The radiation-curable materials comprise preferably less than 20% by weight, in particular less than 10% by weight, of organic solvents and/or water. Preferably they are solvent-free and water-free (referred to as 100% systems). In this case it is possible with preference to do without a drying step.

Besides the radiation-curable compounds as binders, the radiation-curable materials may comprise further constituents. Suitable examples include pigments, leveling agents, dyes, stabilizers, etc.

For curing with UV light it is customary to use photoinitiators.

Photoinitiators which can be used are photoinitiators known to the skilled worker, examples being those specified in "Advances in Polymer Science", Volume 14, Springer Berlin 1974 or in K. K. Dietliker, Chemistry and Technology of UV and EB Formulation for Coatings, Inks and Paints, Volume 3; Photoinitiators for Free Radical and Cationic Polymerization, P. K. T. Oldring (Ed.), SITA Technology Ltd, London.

Suitable examples include phosphine oxides, benzophenones, α-hydroxyalkyl aryl ketones, thioxanthones, anthraquinones, acetophenones, benzoins and benzoin ethers, ketals, imidazoles or phenylglyoxylic acids.

Phosphine oxides are, for example, mono- or bisacylphosphine oxides, such as Irgacure® 819 (bis(2,4,6-trimethylbenzoyl)phenylphosphine oxide), as described for example in EP-A 7 508, EP-A 57 474, DE-A 196 18 720, EP-A 495 751 or EP-A 615 980, examples being 2,4,6-trimethylbenzoyidiphenylphosphine oxide (Lucirin® TPO), ethyl 2,4,6-trimethylbenzoylphenylphosphinate, and bis(2,6-dimethoxybenzoyl)-2,4,4-trimethylpentylphosphine oxide;

benzophenones are for example benzophenone, 4-aminobenzophenone, 4,4'-bis(dimethylamino)benzophenone, 4-phenylbenzophenone, 4-chlorobenzophenone, Michler's ketone, o-methoxybenzophenone, 2,4,6-trimethylbenzophenone, 4-methylbenzophenone, 2,4-Dimethylbenzophenone, 4-Isopropylbenzophenone, 2-chlorobenzophenone, 2,2'-dichlorobenzophenone, 4-methoxybenzophenone, 4-propoxybenzophenon or 4-butoxybenzophenone;

α-hydroxyalkyl aryl ketones are for example 1-benzoylcyclohexan-1-ol (1-hydroxycyclohexyl phenyl ketone), 2-hydroxy-2,2-dimethylacetophenone (2-hydroxy-2-methyl-1-phenylpropan-1-one), 1-hydroxyacetophenone, 1-[4-(2-hydroxyethoxy)phenyl]-2-hydroxy-2-methyl-1-propan-1-one, and polymer comprising 2-hydroxy-2-methyl-1-(4-isopropen-2-ylphenyl)propan-1-one in copolymerized form (Esacure® KIP 150);

xanthones and thioxanthones are for example 10-thioxanthenone, thioxanthen-9-one, xanthen-9-one, 2,4-dimethylthioxanthone, 2,4-diethylthioxanthone, 2,4-di-isopropylthioxanthone, 2,4-dichlorothioxanthone, and chloroxanthenone;

anthraquinones are for example β-methylanthraquinone, tert-butylanthraquinone, anthraquinonecarbonyl acid esters, benz[de]anthracen-7-one, benz[a]anthracene-7,12-dione, 2-methylanthraquinone, 2-ethylanthraquinone, 2-tert-butylanthraquinone, 1-chloroanthraquinone, and 2-amylanthraquinone;

acetophenones are for example acetophenone, acetonaphthoquinone, valerophenone, hexanophenone, α-phenylbutyrophenone, p-morpholinopropiophenone, dibenzosuber-one, 4-morpholinobenzophenone, p-diacetylbenzene, 4'-methoxyacetophenone, α-tetralone, 9-acetylphenanthrene, 2-acetylphenanthrene, 3-acetylphenanthrene, 3-acetylindole, 9-fluorenone, 1-indanone, 1,3,4-triacetylbenzene, 1-acetonaphthone, 2-acetonaphthone, 2,2-dimethoxy-2-phenylacetophenone, 2,2-diethoxy-2-phenylacetophenone, 1,1-dichloroacetophenone, 1-hydroxyacetophenone, 2,2-diethoxyacetophenone, 2-methyl-1-[4-(methylthio)phenyl]-2-morpholinopropan-1-one, 2,2-dimethoxy-1,2-diphenylethan-2-one, 2-benzyl-2-dimethylamino-1-(4-morpholinophenyl)butan-1-one; benzoins and benzoin ethers are for example 4-morpholinodeoxybenzoin, benzoin, benzoin isobutyl ether, benzoin tetrahydropyranyl ether, benzoin methyl ether, benzoin ethyl ether, benzoin butyl ether, benzoin isopropyl ether, and 7-H-benzoin methyl ether;

ketals are for example acetophenone dimethyl ketal, 2,2-diethoxyacetophenone, and benzyl ketals, such as benzyl dimethyl ketal, phenylglyoxylic acids as described in DE-A 198 26 712, DE-A 199 13 353 or WO 98/33761, or other photoinitiators, such as benzaldehyde, methyl ethyl ketone, 1-naphthaldehyde, triphenylphosphine, tri-o-tolylphosphine, 2,3-butanedione or mixtures thereof, such as, for example 2-hydroxy-2-methyl-1-phenylpropan-2-one and 1-hydroxycyclohexyl phenyl ketone, bis(2,6-dimethoxybenzoyl)-2,4,4-trimethylpentylphosphine oxide and 2-hydroxy-2-methyl-1-phenylpropan-1-one, benzophenone and 1-hydroxycyclohexylphenyl ketone, bis(2,6-dimethoxybenzoyl)-2,4,4-trimethylpentylphosphine oxide and 1-hydroxycyclohexyl phenyl ketone, 2,4,6-trimethylbenzoyldiphenylphosphine oxide and 2-hydroxy-2-methyl-1-phenylpropan-1-one, 2,4,6-trimethylbenzophenone and 4-methylbenzophenone, 2,4,6-trimethylbenzophenone and 4-methylbenzophenone and 2,4,6-trimethylbenzoyldiphenylphosphine oxide.

It is an advantage of the invention that the amount of photoinitiators in the radiation-curable material can be low.

The radiation-curable materials comprise preferably less than 10 parts, in particular less than 4 parts, and more preferably less than 1.5 parts by weight of photoinitiator per 100 parts by weight of radiation-curable compounds.

In particular an amount of from 0 part by weight to 1.5 parts by weight is sufficient, in particular 0.01 to 1 part by weight of photoinitiator.

Customary processes may be used to apply the radiation-curable composition to the substrate that is to be coated, or to bring it into the appropriate shape.

Radiation curing can be carried out as soon as the substrate is surrounded by the inert gas.

The method of the invention is suitable for producing coatings on substrates and for producing moldings.

Suitable substrates are for example wood, paper, textile, leather, nonwoven, plastics surfaces, glass, ceramic, mineral building materials, such as shaped cement components and fiber cement slabs, or coated or uncoated metals, preferably plastics or metals, which may also be in the form of foils or films, for example.

Plastics are for example thermoplastic polymers, especially polymethyl methacrylates, polybutyl methacrylates, polyethylene terephthalates, polybutylene terephthalates, polyvinylidene fluorides, polyvinyl chlorides, polyesters, polyolefins, acrylonitrile-ethylene-propylene-diene-styrene copolymers (A-EPDM), polyetherimides, poly-etherketones, polyphenylene sulfides, polyphenylene ethers or mixtures thereof.

Mention may additionally be made of polyethylene, polypropylene, polystyrene, polybutadiene, polyesters, polyamides, polyethers, polycarbonate, polyvinylacetal, polyacrylonitrile, polyacetal, polyvinyl alcohol, polyvinyl acetate, phenolic resins, urea resins, melamine resins, alkyd resins, epoxy resins or polyurethanes, block or graft copolymers thereof, and blends thereof.

As plastics mention may be made preferably of ABS, AES, AMMA, ASA, EP, EPS, EVA, EVAL, HDPE, LDPE, MABS, MBS, MF, PA, PA6, PA66, PAN, PB, PBT, PBTP, PC, PE, PEC, PEEK, PEI, PEK, PEP, PES, PET, PETP, PF, PI, PIB, PMMA, POM, PP, PPS, PS, PSU, PUR, PVAC, PVAL, PVC, PVDC, PVP, SAN, SB, SMS, UF, and UP plastics (abbreviations according to DIN 7728) and aliphatic polyketones.

Particularly preferred plastics substrates are polyolefins, such as PP (polypropylene), for example, which may be isotactic, syndiotactic or atactic and may be unoriented or may have been oriented by uniaxial or biaxial drawing, SAN (styrene-acrylonitrile co-polymers), PC (polycarbonates), PMMA (polymethyl methacrylates), PBT (poly(butylene terephthalate)s), PA (polyamides), ASA (acrylonitrile-styrene-acrylate copolymers) and ABS (acrylonitrile-butadiene-styrene copolymers), and also their physical mixtures (blends). Particular preference is given to PP, SAN, ABS, ASA and also to blends of ABS or ASA with PA or PBT or PC.

As moldings mention may be made, for example, of composites, comprising woven fabric or fiber materials impregnated with radiation-curable material, for example, or moldings for stereolithography.

The invention claimed is:

1. Apparatus 1 for effecting a cure of coatings on a substrate S under an inert gas atmosphere, comprising side covers (2), (3), (4), and (5), top and bottom covers (6) and (7), with (2), (3), (4), (5), (6) and (7) together enclosing an interior, one or more dividing walls (8) which subdivide the interior, the dividing walls (8) finishing at the bottom cover (7) and leaving open a distance (d1) from the top cover (6), one or more dividing walls (9) which subdivide the interior, the dividing walls (9) finishing at the top cover (6) and leaving open a distance d2 from the bottom cover (7), with (8) and (9), together with the respectively adjacent dividing wall (8) and (9), and optionally, with the side covers (2) or (3), forming a subdivided interior (compartment), at least one radiation source (10) radiating within the interior or into the interior or both, at least one gas supply means (11), with which a gas or gas mixture can be passed into the interior or formed therein, at least one conveying means (12) for the substrate (S), inlet (13) and outlet (14), where the dividing walls (8) stand substantially perpendicular to the bottom cover (7), the dividing walls (9) stand substantially perpendicular to the top cover (6), the distances (d1) and (d2) and also the breadth (b) of apparatus (1) being chosen such that they are greater than the dimensions of the substrate (S) along the conveying direction of the conveying means (12), and means (2), (3), (8) and (9) form at least 4 compartments.

2. The apparatus according to claim 1, wherein the cross-sectional area through which the substrate is conveyed through the individual compartments in the apparatus is at least three times the projected cross-sectional area of the substrate in the conveying direction.

3. The apparatus according to claim 2, wherein the cross-sectional areas, are not more than six times as great as the projected cross-sectional area of the substrate (S) in the conveying direction.

4. The apparatus according to claim 1, wherein the number of compartments is 4 to 15.

5. The apparatus according to claim 1, wherein the number of compartments is 6 to 8.

6. The apparatus according to claim 1, wherein the inert gas atmosphere is composed predominantly of nitrogen or carbon dioxide or a mixture thereof.

7. The apparatus according to claim 1, wherein the inert atmosphere has an oxygen content of below 3% by volume.

8. The apparatus according to claim 1, wherein the height h of a compartment is at least twice as great as the greater of the distances (d1) and (d2).

9. The apparatus according to claim 1, wherein the dividing walls (8) and (9) deviate not more than 30° from the perpendicular with the covers (7) and (6) respectively.

10. The apparatus according to claim 1, wherein the radiation source (10) comprises a UV wavelength λ of 200 nm to 760 nm.

11. The apparatus according to claim 1, wherein the radiation source (10) comprises an NIR or IR wavelength λ of 760 nm to 25 μm.

12. The apparatus according to claim 1, wherein the supply of gas via the gas supply means (11) is not more than two times an internal volume of the apparatus per hour.

13. The apparatus according to claim 1, wherein the entry (13) is formed over at least one length (f1) which is 0 to 10 times the parameters (d1) or (d2), depending on which of these two parameters is the greater.

14. The apparatus according to claim 1, wherein the exit (14) is formed over at least one length (f2) which is 0 to 10 times the parameters (d1) or (d2), depending on which of these two parameters is the greater.

15. The apparatus according to claim 1, wherein entry (13) or exit (14) or both are sealed with suitable means to prevent gas fluid loss.

16. The apparatus according to claim 1, wherein the inert gas is heavier than air and the inert gas is supplied via a gas supply means (11) in the lower third of apparatus (1), based on its height (h).

17. The apparatus according to claim 16, wherein the inert gas is metered in via a gas supply means (11) at a temperature which is below the temperature of the inert gas atmosphere.

18. The apparatus according to claim 16, wherein entry (13) or exit (14) or both of the apparatus are disposed in the upper half of the apparatus, based on the height h of the apparatus.

19. The apparatus according to claim 1, wherein the inert gas is lighter than air and the inert gas is supplied via a gas supply means (11) in the upper third of apparatus (1), based on its height (h).

20. The apparatus according to claim 19, wherein the inert gas is metered in via a gas supply means (11) at a temperature which is above the temperature of the inert gas atmosphere.

21. The apparatus according to claim 19, wherein entry (13) or exit (14) or both of the apparatus are disposed in the lower half of the apparatus, based on the height (h) of the apparatus.

22. The apparatus according to claim 1, wherein the side covers (2), (3), (4), (5) or a combination thereof and also the top and bottom covers (6) or (7) or both are thermostated or insulated.

23. A method of effecting a cure of coatings on a substrate (S) under an inert gas atmosphere, wherein the cure is effected in apparatus according to claim 1.

24. The method according to claim 23, wherein the temperature in the apparatus is at least partly 50° C. or more.

25. The method of using apparatus according to claim 1 for effecting a cure of coating materials on a substrate (S).

* * * * *